US006382126B1

(12) United States Patent
Findley

(10) Patent No.: US 6,382,126 B1
(45) Date of Patent: May 7, 2002

(54) REFLECTIVE AND ADHESIVE PATCH

(76) Inventor: Craig Alan Findley, 20 S. First St., Sharpsville, PA (US) 16150

( * ) Notice: Subject to any disclaimer, the term of this patent is extended or adjusted under 35 U.S.C. 154(b) by 0 days.

(21) Appl. No.: 09/672,747

(22) Filed: Sep. 28, 2000

(51) Int. Cl.[7] ..... G09F 13/16
(52) U.S. Cl. ..... 116/209; 40/583; 40/447
(58) Field of Search ..... 116/209, 202, 116/306, 321, 322, 63 P, 63 R, 278, 323; 40/582, 583, 447, 450

(56) References Cited

U.S. PATENT DOCUMENTS 2,078,103 A 4/1937 Simmons
3,800,730 A 4/1974 Taylor
3,964,197 A 6/1976 Tucker et al.
4,016,665 A * 4/1977 Sakota ..... 40/135
4,913,946 A * 4/1990 Sala et al. ..... 428/38
5,349,920 A * 9/1994 Koizumi ..... 116/28 R
5,398,391 A * 3/1995 Yokochi ..... 24/616
5,697,174 A * 12/1997 Gassman ..... 40/447
5,751,212 A * 5/1998 Findley ..... 116/63 P

* cited by examiner

*Primary Examiner*—Andrew H. Hirshfeld
*Assistant Examiner*—Travis Reis
(74) *Attorney, Agent, or Firm*—Aileen Champion Addessi

(57) ABSTRACT

A reflective safety, signal, and warning patch is disclosed that is attachable to clothing articles worn by an individual or to an object includes a plurality of reflective panels that can have a variety of geometric configurations that are arranged in either rows or columns on one surface of the patch, and each row and column of panels is mounted to the patch by a wire that extends through each panel of that respective row and column. Each panel incorporates a reflective, prismatic, or fluorescent material, and is capable of slidable movement on the wires to diffuse reflected light thus producing a broken-up pattern of light dissemination for enhancing the visibility of the light and the individual wearing the patch or patches, especially during the dusk, twilight, and nighttime hours.

20 Claims, 2 Drawing Sheets

REFLECTIVE AND ADHESIVE PATCH

BACKGROUND OF THE INVENTION

The present invention relates to reflective devices, and, more particularly, relates to reflective devices that are attachable to an individual's clothing in order to increase the visibility of the individual during both daytime and nighttime.

In many recreational and work activities, the safety of the individual undertaking or engaged in the activity is a primary concern. The safety of the individual is a more critical concern when the activity is undertaken or engaged in during the dusk, twilight, or nighttime hours. Recreational activities such as walking, running, bicycling, and skateboarding often occur at dusk or nighttime when visibility is minimal. Such activites may occur on athletic tracks and fields, sidewalks, and frequently adjacent or on busy city streets. Visibility is obviously crucial if the individual is to avoid injury, or even death, resulting primarily from being struck by an automotive vehicle. Because of the enormous changes in society over the last several decades which include increases in shift work, home occupations and businesses, leisure time, and a stress on physical fitness for all ages, it is not uncommon to see walkers, runners, skateboarders, rollerbladers and bicyclists, from the spritely young to the vigorous elderly, involved in these pursuits from sunrise through sunset, and even into the nighttime hours.

Moreover, work and employment activities are also conducted from the sunset and twilight hours through the night and to sunrise. Policemen, firemen, and other public safety personnel are on the job 24 hours a day, and may be as active at night as during the day. While each profession uses a recommended flashlight, and sometimes safety flares, occasions arise where both hands must be used for the task at hand and thus a flashlight cannot be properly utilized. In addition, highway construction crews, road crews, surveyors, sanitation workers, to cite just a few occupations, often work at night adjacent to, or on well traveled, busy highways. Signal flares, large fluorescent signs, and electronically flashing signs are commonly used to warn approaching motorists of a construction area or highway accident. Jackets or vests incorporating fluorescent material or having fluorescent strips of material sewn on or affixed thereto provide some visibility for the workers, but for vehicles traveling in excess of 50 or 60 miles per hour, the amount of disseminated light and the radius of visibility of the light is inadequate, and actually provides the driver with little advance warning that his or her vehicle is rapidly advancing upon a human being located in a very vulnerable position adjacent or on a highway.

In order to enhance the safety and increase the visibility of individuals involved in activities that extend into the nighttime hours, a variety of devices and systems have been employed.

The prior art discloses a number of signal-type devices for warning individuals and drivers that they are approaching a human being located adjacent or on a roadway or for locating individuals that are lost.

The Simmons patent (U.S. Pat. No. 2,078,103) discloses a reflecting signal device that can be worn on either wrist to apprise traffic of turns or intended maneuvers. The Simmons device includes a pair of arcuate plates that are connected together by spring hinges. Each plate has affixed thereto an arcuate glass plate preferably of reflective or prismatic glass. When worn on the wrist of the driver, the driver can signal his or her intentions by holding his or her arm out the vehicle's window, and then moving or waving the arm in the appropriate manner to provide advance warning to other drivers.

The Taylor patent (U.S. Pat. No. 3,800,730) discloses a portable, hand held signal device that includes a handle and two plates pivotally connected along one edge. Each plate has received a fluorescent paint treatment for increasing the visibility of the device during both daytime and nighttime hours.

The Tucker et al. device (U.S. Pat. No. 3,964,197) discloses a versatile outdoor sign in which letters or messages can be created by rearranging a plurality of chips within a mesh framework. In order to make the message more eye catching, the chips can be treated with a reflective or fluorescent coating.

Nonetheless, the above-described devices do not maximize the visibility of and individual at nighttime from an adequate safety distance, nor do the above-described devices provide for an increase in reflective or fluorescent surfaces or surfaces areas to thereby enhance the fluorescence or reflectivity of the device and, thus, the visibility of the individual using or wearing the device.

SUMMARY OF THE INVENTION

The present invention comprehends reflective signal devices, and, more particularly, comprehends a reflective device that is attachable to clothing articles word by an individual and that conforms to the movement of the clothing articles and diffuses reflected light to provide for greater visibility of the individual.

The reflective signal and warning device of the present invention includes a reflective and adhesive patch that is removably mountable to any portion or area of an individual's clothing article, such as a portion or area of the coat sleeve, collar, or any suitable part of a coat, jacket, vest, or sweater.

The reflective and adhesive patch includes a frame that has an adhesive substance impressed, formed, or coated on the frame's rear surface. A peel away paper strip covers the adhesive substance, and can be quickly removed for exposing the adhesive substance and pressing the adhesive substance against the clothing article for mounting the patch to the clothing article. The patch is preferably made from a pliable fabric or cloth material that allows the patch to bend, flex, and conform, to some degree, to the movements of the clothing article. Mounted to the front surface of the frame are a plurality of panels, and the panels are secured to the frame preferably by wires whereupon each row or column of panels has one wire extending through that respective panel row. Each wire is secured to the frame adjacent the border or periphery of the frame. The shape of the panels could be in almost any geometric form from simple rectangular, cylindrical, and circular forms to, for example, complex icosahedrons. The panels are coated or painted with a reflective, prismatic, or fluorescent material to maximize the visibility of the panels, and, furthermore, the panels are capable of some slidable, back and forth movement on the wires to further diffuse any reflected light and thereby enhance the reflectivity and visibility of the panels.

It is an objective of the present invention to provide a reflective signal, safety, and warning device that is easily and quickly mountable to and removable from any type of clothing article such as a hat, helmet, vest, coat, or pants.

It is another objective of the present invention to provide a reflective signal, safety, and warning device that enhances light reflectivity by utilizing panels that incorporate numerous geometric configurations to achieve maximum light diffusion, It is yet another objective of the present invention to provide a reflective signal, safety, and warning device that includes reflective panels having geometric configurations that break up and diffuse the light reflected from the panels for producing a continuous twinkling effect and thus increasing the visibility of the individual who is wearing the patch.

These and other objects, features, and aspects of the invention will become clear from a reading of the detailed description of the invention, the accompanying figures, and the appended claims.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

Illustrated in FIGS. 1–6 is a portable, reflective, safety, signal and warning device that is removably attachable to any portion or area of an individual's article of clothing in order to reflect light therefrom and thereby increase the visibility of the individual. Preferably the safety device would be attached to the sleeves or the front or back of the individual's coat. The safety device could also be affixed to the individual's pant legs and cuffs as well as to hats, vests, wristbands, armbands, and headbands. The safety device of the present invention has wide applicability and, for example, can be mounted to the vest, overcoat, hat or helmet of a policeman or fireman. Moreover, the safety device can also be mounted to a bicyclist's helmet, a construction worker's vest or a sanitation worker's coveralls. Indeed, the safety device can be used in conjunction with any activity conducted or engaged in during and throughout the dusk, twilight, and nighttime hours for protecting an individual engaging in an activity that puts him in a precarious or dangerous position such as on a construction site, adjacent or on a highway directing traffic, collecting garbage, walking, running, bicycling, conducting a traffic stop or attending to an accident scene. The patch 10 may also be attached to any object, such as a sign or the like.

As shown in FIGS. 1–6, the safety, signal, and warning device of the present invention comprises a parallelogram-shaped reflective patch 10 that is removably attachable to an area or portion of an article of clothing. While the reflective patch 10 can be of almost any geometric configuration, a square or rectangular-shaped patch is preferred. The patch 10 should be pliable in order to flex, bend, and conform to the shape and movement of the clothing article when worn by the individual, and is therefore preferably manufactured from a pliant, cloth-type material, a flexible plastic material, a rubber material, or other similar type of material.

Figure 1:
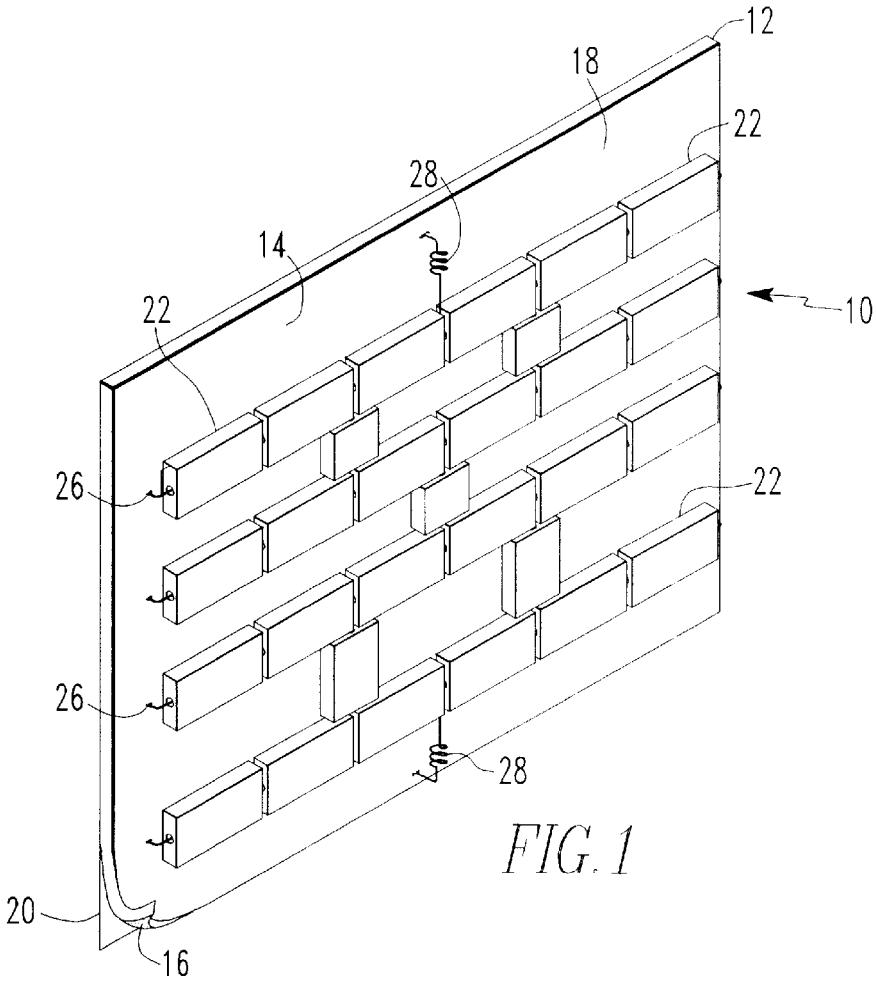
FIG. 1 is a perspective view of the reflective and adhesive patch of the present invention.
Figure 2:
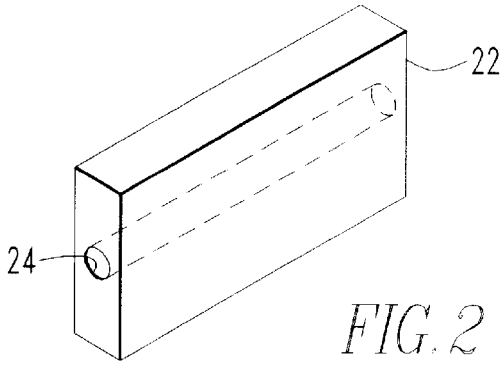
FIG. 2 is a perspective view of one geometric configuration for the panels that are mounted to the patch.
Figure 3:
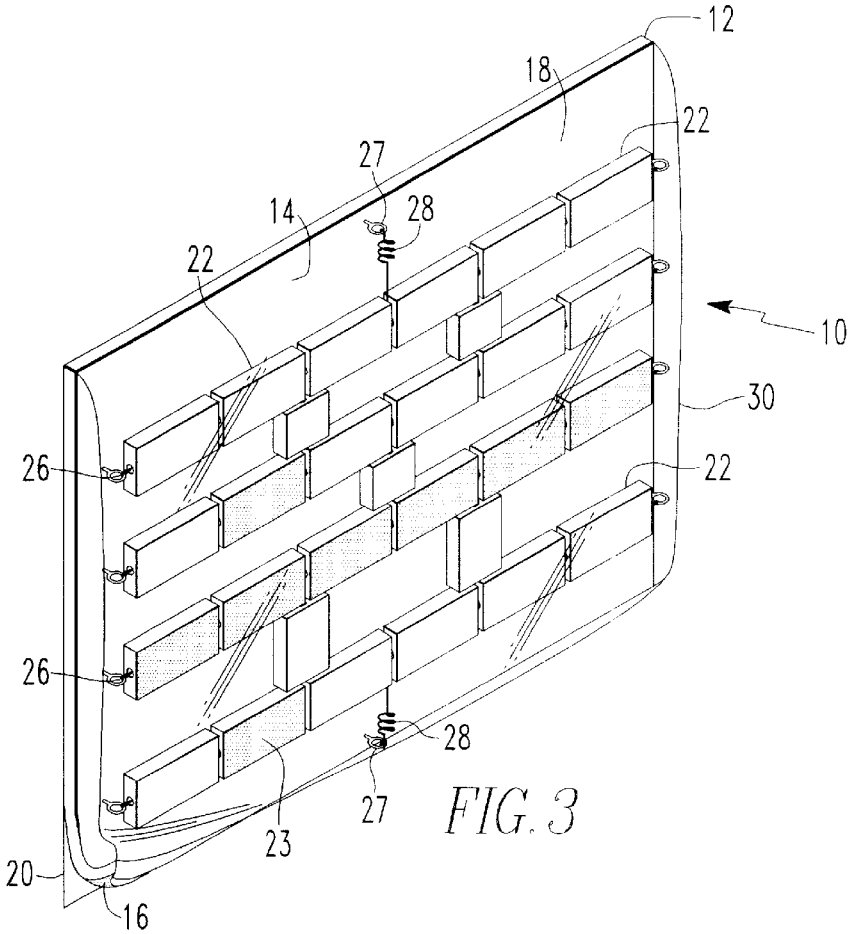
FIG. 3 is a perspective view of an alternative embodiment of the reflective and adhesive patch first shown in FIG. 1.
Figure 4:
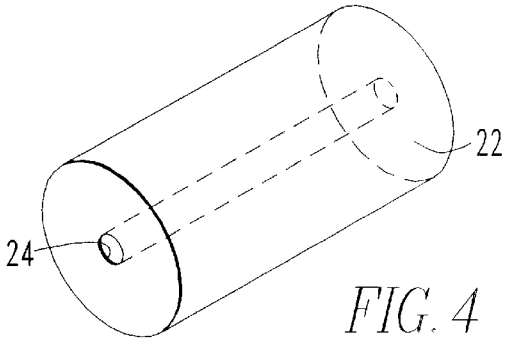
FIG. 4 is a perspective view of a cylindrical panel.
Figure 5:
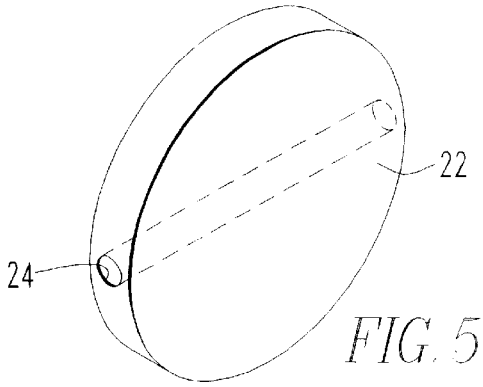
FIG. 5 is a perspective view of a circular panel.
Figure 6:
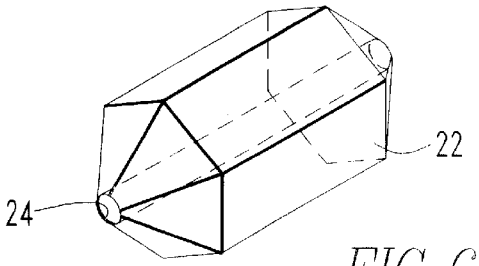
FIG. 6 is a perspective view of a panel having a multitude of faces.

As shown in FIGS. 1–6, the reflective patch 10 is defined by a frame 12 that includes a front surface 14, an opposite rear surface 16, and a peripheral border or margin 18 extending about the front surface 14. While the patch 10 could be snapped or fastened to the clothing article, the preferred manner of mounting the patch 10 to the clothing article is by manually adhering the patch 10 to the clothing article. Thus, as shown in FIGS. 1 and 3, the rear surface 16 of the frame 12 is treated or coated with an adhesive substance. The adhesive substance is fully covered and protected by a strip of paper 20 having the same dimensions as the rear surface 16 of the frame 12. The paper strip 20 can be easily and quickly peeled away to expose the adhesive substance whereupon the individual would firmly press the rear surface 16 of the frame 12 against the clothing article to mount the patch 10 to the clothing article. Although the reflective patch 10 will have a minimum size for manufacturing purposes, the maximum size of any particular patch 10 will be constrained by the respective activity for which the patch 10 is to be used and the type of clothing article, and the place or area on the clothing article on which the patch 10 will be mounted. However, the patch 10 is adaptable for many different uses, and the patch 10 could be adapted for specific uses by, for example, runners, bicyclists, firemen, and policemen.

As illustrated in FIGS. 1–6, the reflective and adhesive patch 10 of the present invention includes a reflective element or structure that reflects ambient light or directed light from a flashlight, headlights, or searchlight in order to warn approaching and advancing individuals, whether on foot, bicycle, motorcycle or automotive vehicle, of the presence of another human being in the vicinity. The reflective element or structure can also be used in a manner similar to a signal flare in that an individual wearing the patch 10 including the reflective element or substance can be more easily discerned, detected, or located.

The reflective element or structure of the present invention includes a plurality of panels 22 arranged in contiguous or staggered rows and/or columns on the front surface 14 of the frame 12. The panels 22 are manufactured preferably from a plastic composition that provides for some pliability so that the panels 22 more easily accommodate the flexuous movements of the patch 10 applied to a clothing article. The panels 22 may be manufactured in the geometric shape representative of almost any polyhedron. FIGS. 2 and 4–6 illustrate panels 22 having simple polyhedron shapes. If manufacturing processes are available and feasible, the geometric configuration of the panel 22 could approach a polyhedron such as a cut diamond that has 50 plus faces.

A panel 22 having a multitude of polygonal faces will reflect, break up, and diffuse light producing a shimmering, twinkling effect that enhances the visibility of the light. The panels 22 do not need to be fully enclosed three dimensional objects, but the panels 22 need oppositely disposed insertion or receiving apertures 24, such as holes, bores, or passageways, as shown in FIGS. 2 and 4–6, for facilitating the attachment of the panels 22 to the front surface 14 of the frame 12. The reflective material or substance applied to, impressed or formed on the panel 22 could be reflective tape, prismatic material, fluorescent paint, or the like. The panels 22 may also be color coded for displaying a message 23, as shown in FIG. 3. The message to be conveyed may include any combination of characters to form words or symbols.

In order to securely mount the panels 22 to the front surface 14 of the frame 12 a single thin gauge wire 26 is inserted through the apertures 24 of all the panels 22 comprising each respective row or column of panels 22. The wire 26 may be metal, string, nylon, or the like. The opposed ends of each wire 26 would then be attached to the front surface 14 adjacent the border 18 of the frame 12 in any number of ways such as by gluing, tying, or sewing the ends of each wire 26 to or into the front surface 14, or by mechanical means, such as eye hooks 27 attached to the frame 12 and clips attached to the wire 26 and engagable with the eye hooks 27. The number of panels 22 included in each row and column would be such as to allow some slight back and forth motion to accommodate the movements of the patch 10 when worn on a clothing article. The number of panels 22 would also depend on the size of each respective patch 10. A slight amount of slack would be provided in the attachment of the wires 26 to the frame 12 as opposed to tautly securing the wires 26 which would hinder the ability of the panels 22 to accommodate the flexion of the patch 10 as a result of the movements of the individual's body and limbs while wearing the particular clothing article. Thus, as an individual would move in any manner, the panels 22 would also slightly slide back and forth on their slidable mounting to the wires 26, and as the panels 22 would move in different directions or orientations with respect to each other, the light would be reflected and diffused from the panels 22 in a multitude of directions thereby enhancing the visibility of the individual wearing the patch 10.

In order to maintain the matrix-type layout or orientation of the panels 22 on the frame 12, a number of small compression springs 28 can be used as shown in FIGS. 1 and 3. The compression springs 28 would generally be mounted on the frame 12 transverse to the extension or run of the wires 26. More specifically, one end of each compression spring 28 would be secured to the front surface 14 of the frame 12 adjacent the periphery 18 thereof, and the opposite second or inner end of each compression spring 28 would be secured to a portion of the wire 26 exposed between two adjacent panels 22. The compression springs 28 would, in effect, compensate for any slackness, however slight, in the wires 26 by pulling on the wires 26 to maintain the generally rectilinear orientation of the wires 26 relative to the front surface 14 of the frame 12. Although FIGS. 1 and 3 show only two compression springs 28, for optimum effectiveness many springs 28 could be arranged about the periphery 18 of the frame 12 for securement to the wires 26 at various points along the length of each wire 26.

In addition, all the panels 22 mounted to each respective patch 10 can be covered and protected by a clear plastic housing 30 that itself would be secured to the front surface 14 of the frame 12. The housing 30 would protect the panels 22 from the elements and enclose both the panels 22 and the wires 26 thereby preventing other objects from getting caught on the wires 26 and lifting the panels 22 completely off the frame 12. When mounting one or more patches 10 to any clothing article, consideration should be given to the type of activity being engaged in by the individual, the amount of visibility desired or necessary for protecting the individual the type of clothing articles being worn, and the location on the clothing article where the patch 10 or patches 10 should be most appropriately mounted. If a plurality of patches 10 are to be used, the individual may need to experiment to determine the configuration or arrangement of the patches 10 that provides the maximum diffusion of light and consequent visibility for protecting the individual.

The foregoing is considered as illustrative only of the principles of the invention Since numerous modifications and changes will readily occur to those skilled in the art, it is not desired to limit the invention to the construction and operation shown and described. Accordingly, all suitable modifications and equivalents may be resorted to, falling within the scope of the invention.

I claim:

1. A reflective patch for securement to an article of clothing that is worn by an individual for illuminating the individual so that the individual can be seen from distance and at nighttime, the patch comprising:

a flexible frame having a front surface, an opposite rear surface, and a peripheral border extending about the front surface, and adapted for removable securement to an article of clothing;

a plurality of panels arranged on the front surface of the frame in a plurality of rows whereby the panels are capable of rotational and slidable movement thereon, each panel having a pair of oppositely disposed receiving holes and a reflective material affixed to the panel; and a plurality of wires extending from one side of the border to the opposite side of the border and mounted to the frame adjacent the border with each wire extending through both receiving holes of all the panels in one respective row of panels thereby securing the panels to the frame and permitting the slidable and rotational movement of the panels on the frame.

2. The reflective patch of claim 1 wherein the rear surface of the frame includes an adhesive substance that can be pressed against the article of clothing for securing the patch to the article of clothing.

3. The reflective patch of claim 2 further comprising a paper strip positioned adjacent the rear surface of the frame for covering and protecting the adhesive substance on the frame and which is peelable from the adhesive substance.

4. The reflective patch of claim 1 further comprising a plurality of springs with each spring having a first spring end attached to the frame adjacent the border and a second spring end attached to one of the wires whereby all the springs apply a continuous force against the wires so that the wires maintain a generally rectilinear orientation on the frame.

5. The reflective patch of claim 1 wherein said plurality of panels are arranged on the front surface of the frame in a plurality of columns whereby the panels are capable of rotational and slidable movement thereon.

6. The reflective patch of claim 1 wherein the reflective material that is affixed to each panel is a strip of reflective tape.

7. The reflective patch of claim 1 wherein the reflective material affixed to each panel is a fluorescent sticker.

8. The reflective patch of claim 1 wherein the reflective material applied to each panel is fluorescent paint.

9. The reflective patch of claim 1 wherein each panel is circular-shaped and includes oppositely-disposed receiving holes for allowing one wire to extend therethrough so that each circular-shaped panel can be mounted to the frame.

10. The reflective patch of claim 1 wherein each panel has the shape of a box-like housing.

11. The reflective patch of claim 1 wherein each panel includes at least five surfaces to which reflective material can be affixed.

12. The reflective patch of claim 1 wherein each panel is cylindrical-shaped and includes an internal passageway coequal in length with the panel for allowing one wire to extend therethrough in order to mount the panel to the frame.

13. The reflective patch of claim 1, further comprising a clear housing attached to the frame and positioned on the front surface of the frame for enclosing the plurality of panels.

14. The reflective patch of claim 1 wherein the panels display a message.

15. A reflective patch, comprising:

a frame having a front surface and an opposite rear surface, the rear surface for securement to an object;

a plurality of panels arranged on the front surface of the frame in a plurality of rows whereby the panels are capable of movement thereon, each panel having a pair of oppositely disposed receiving holes and a reflective material affixed to the panel; and a plurality of wires extending across the front surface of the frame and mounted to the frame with each wire extending through both receiving holes of all the panels in one respective row of panels thereby securing the panels to the frame and permitting the movement of the panels on the frame.

16. The reflective patch of claim 15 wherein the plurality of panels are arranged in a plurality of columns intertwined with the rows of panels for forming a webbing of panels on the front surface of the frame.

17. The reflective patch of claim 15 wherein the rear surface of the frame includes an adhesive substance that can be pressed against the object for securing the patch to the object.

18. The reflective patch of claim 15, further comprising a plurality of springs attached between the frame and the wires whereby all the springs apply a continuous force against the wires for enhancing movement of the panels.

19. The reflective patch of claim 15, further comprising a clear housing attached to the frame and positioned on the front surface of the frame for enclosing the plurality of panels.

20. The reflective patch of claim 15 wherein the panels display a message.

* * * * *